United States Patent [19]

Garcia

[11] 4,243,354

[45] Jan. 6, 1981

[54] DRUM LIFTER FOR FORK LIFT TRUCK

[75] Inventor: Jose M. Garcia, Miami, Fla.

[73] Assignee: Equipment Company of America, Hialeah, Fla.

[21] Appl. No.: 35,882

[22] Filed: May 4, 1979

[51] Int. Cl.[3] ..... B66F 9/18

[52] U.S. Cl. ..... 414/607; 414/622; 294/90

[58] Field of Search ..... 414/607, 618, 619, 622; 294/90

[56] References Cited

U.S. PATENT DOCUMENTS

| | | | |
|---|---|---|---|
| 2,905,347 | 9/1959 | Hopfeld | 414/622 |
| 3,310,336 | 3/1967 | Chenault | 294/90 |
| 3,333,883 | 8/1967 | Kikuchi | 294/90 |
| 3,512,670 | 5/1970 | Howard | 414/607 |
| 4,018,468 | 4/1977 | Lundquist | 294/90 |
| 4,130,212 | 12/1978 | Gatilao | 414/622 |
| 4,182,531 | 1/1980 | Szegheo | 294/90 |

*Primary Examiner*—Joseph E. Valenza

*Attorney, Agent, or Firm*—Cullen, Sloman, Cantor, Grauer, Scott & Rutherford

[57] ABSTRACT

A drum lifter comprises a base including a pair of parallel spaced fork tubes adapted for receiving at one end and positioning over a pair of vertically adjustable forks of a fork lift truck, and a support plate spanning and secured to the other end of the tubes. An upright mount plate is secured to the support plate. An upright drum support plate is parallel to, arranged forwardly and pivotally mounted intermediate the ends upon the mount plate. First and second drum grips on the drum support plate are adapted to operatively engage the exterior of a drum to be lifted and transported. A forwardly extending latch link is pivotally supported upon the mount plate adjacent its upper end and pivotally mounts the drum support plate. A third drum grip depends from the forward end of the latch link and is adapted to retainingly engage over and against the interior of the drum.

26 Claims, 6 Drawing Figures

DRUM LIFTER FOR FORK LIFT TRUCK

BACKGROUND OF THE INVENTION

Heretofore, various types of trucks have been designed for lifting drums and supporting the same over a floor surface. Illustrative of such prior art devices are the following United States Patents No.:

1,798,565
2,787,509
2,797,832
3,263,822
3,438,523
3,576,333
3,677,436
2,733,074
2,793,868
2,823,921
2,922,658

Most of these devices are directed to truck constructions which are manually movable over the ground surface and have manually operable control devices for grasping a drum and lifting the same.

SUMMARY OF THE INVENTION

It is a feature of the present invention to provide an improved drum lifter particularly adapted for fork lift trucks and wherein, the drum lifter mechanism is adapted for reception over the vertically adjustable forks of such a truck and includes a pair of spaced drum-engaging jaws upon a drum support plate to operatively engage the exterior of a drum, and an angularly adjustable third grip upon a pivotal latch link to supportably engage the interior of the drum. It is another feature to provide an imporved drum lifter for fork lift trucks wherein the third jaw and its supporting latch link are adapted to assume a released elevated drum disengaging cocked position either for disengaging a drum which has been transported by the lifter, or positioning the lifter for engagement with a drum upon a support which is to be gripped and lifted and transported.

It is a further feature to provide an improved drum lifter for a fork lift truck and wherein the base mounts over and is secured to the forks of such truck and carries an upright mount plate to which is pivotally connected intermediate the ends an upright drum support plate having a pair of drum grips to engage the exterior of a drum and wherein the upper end of the drum support plate is pivotally suspended adjustably from a latch link pivotally mounted upon a mount plate and wherein the latch link carries a third grip adapted for operative engagement with the interior of a drum to be gripped and transported.

These and other features will be seen from the following Specification and Claims in conjunction with the appended drawings.

THE DRAWINGS

It will be understood that the above drawings illustrate merely a preferred embodiment of the invention, and that other embodiments are contemplated within the scope of the Claims hereafter set forth.

DETAILED DESCRIPTION OF THE INVENTION

Figure 1:
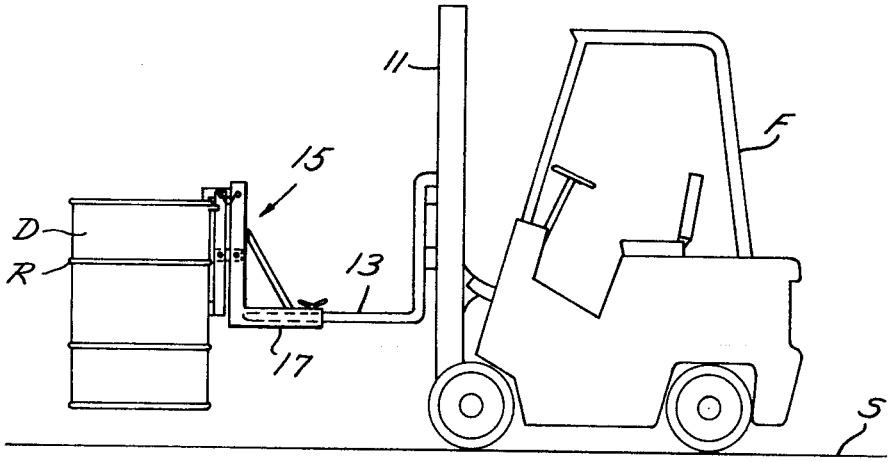
FIG. 1 is a schematic side elevational view of a fork lift truck upon a support surface to which has been applied the present drum lifter with a drum gripped thereby and suspended over the support surface.
Figure 2:
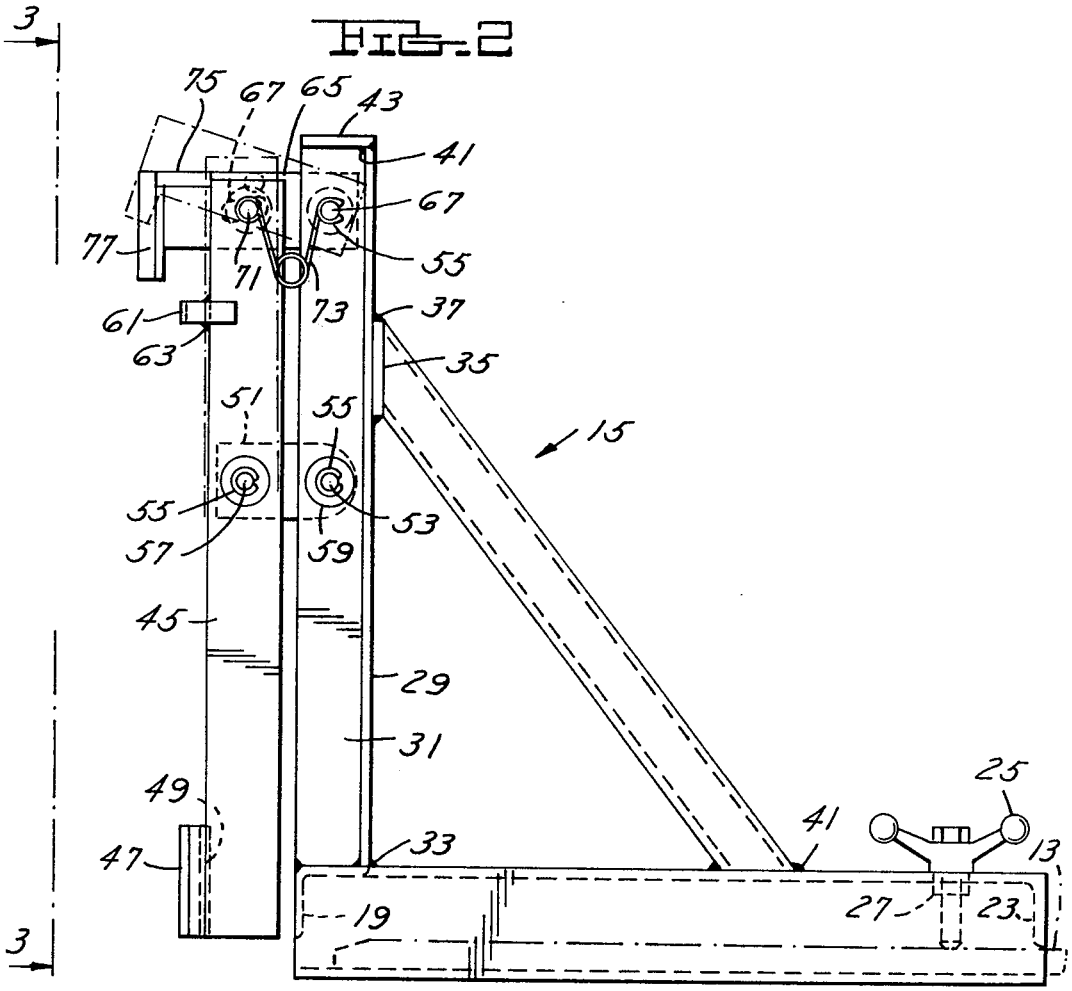
FIG. 2 is a side elevational view of the drum lifter on an increased scale.
Figure 3:
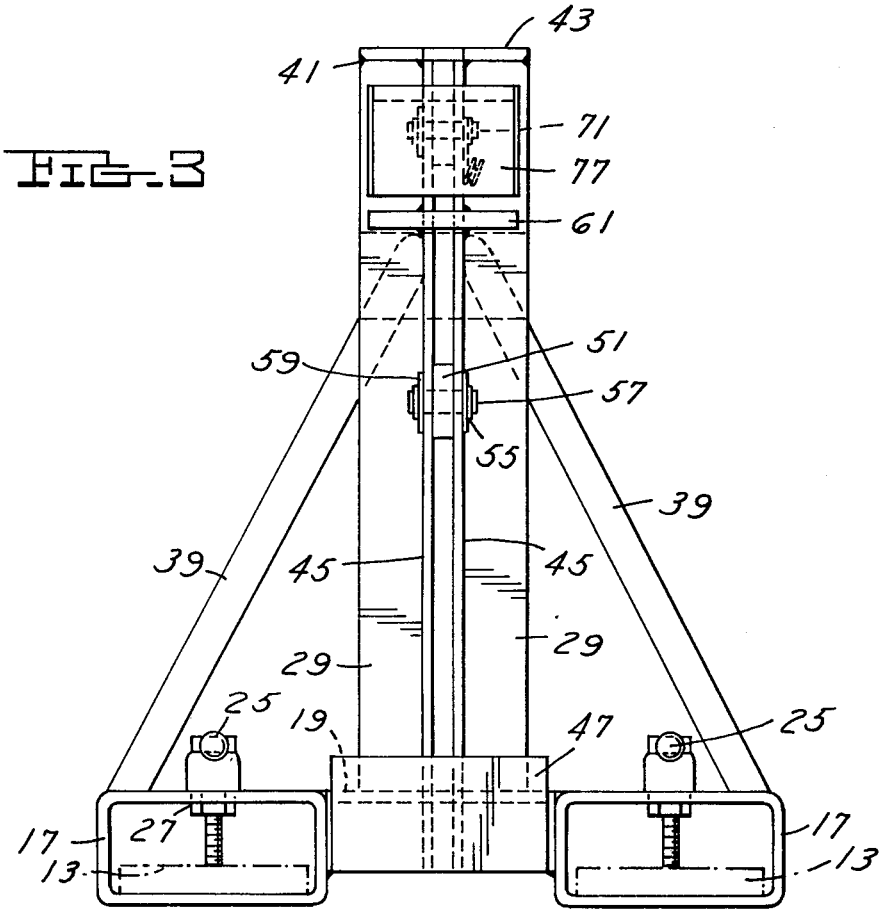
FIG. 3 is a front elevational view taken in the direction of arrows 3—3 of FIG. 2.
Figure 5:
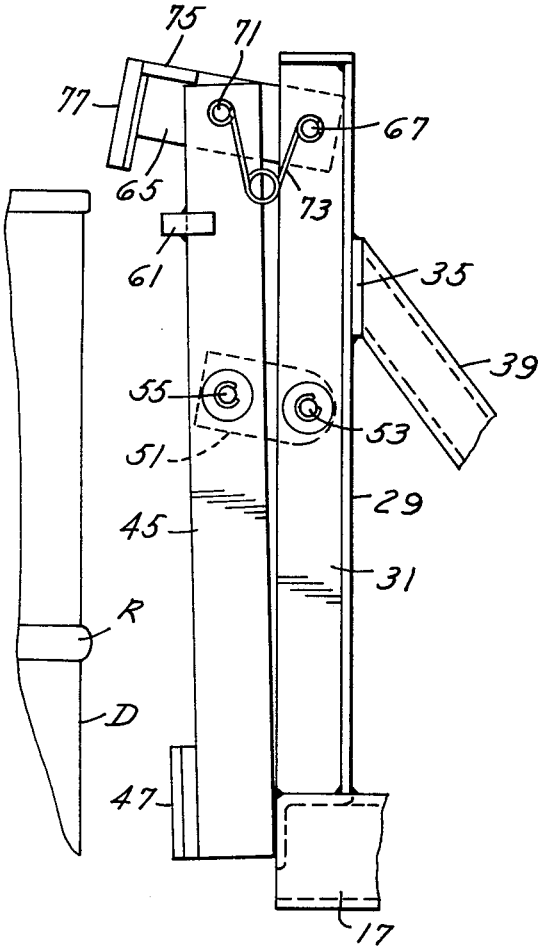
FIG. 5 is a fragmentary side view corresponding to FIG. 2 with the grip in a cocked position.
Figure 6:
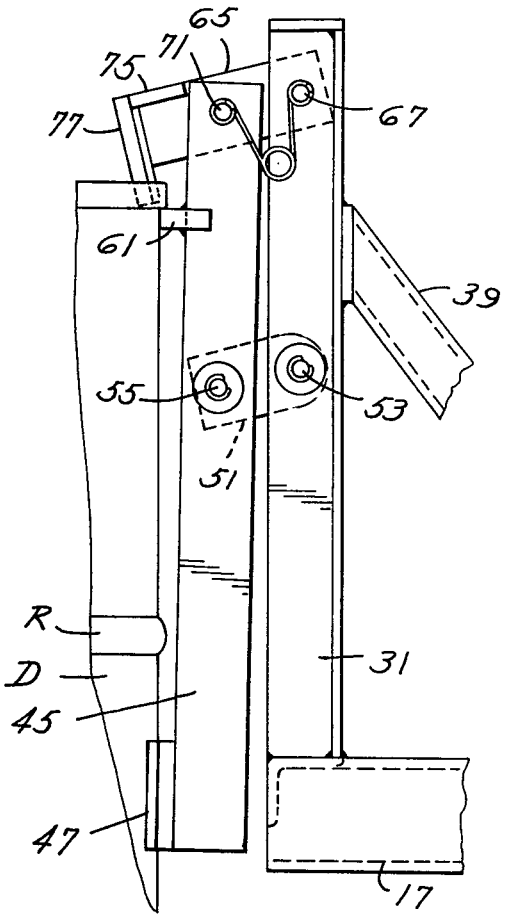
FIG. 6 is a similar view corresponding to FIG. 1, on an increased scale.

Referring to the drawings a fork lift truck is schematically indicated at F in FIG. 1 upon support surface S including a conventional elevator 11 for adjustably mounting a pair of forwardly extending parallel forks 13 of conventional construction shown also in FIGS. 2 and 3. The present drum lifter is generally indicated at 15 FIG. 1 which comprises a base consisting of a pair of parallel spaced fork tubes 17 adapted for receiving at one end and positioning over a pair of vertically adjustable forks 13 of the fork lift truck F, FIG. 1.

The drum held elevated in FIG. 1 is generally designated at D and includes a pair of spaced annular ribs R. The base includes the transverse support plate or angle plate 19 which spans the fork tubes 17 at the other ends thereof and is secured thereto as by the welds 21 FIG. 4. The base also includes spacer reinforcement angle plate 23 which interconnects the other ends of the fork tubes 17 and is secured thereto as by the welds 21.

Manually adjustable wing bolts 25 are threaded into nuts 27 secured upon the interior of the fork tubes 17 and are adapted to operatively and retainingly engage surface portions of the fork 13 when assembled into the fork tubes 17 as shown in FIGS. 2 and 3. An upright mount plate in the present embodiment includes a pair of upright angle plates 29 having opposed parallel spaced apart webs 31. The angle plates 29 are mounted upon support plate 19 and secured thereto as by the welds 33.

Cross plate 35 FIG. 2 spans plates 29 intermediate their ends and is secured thereto by the welds 37.

The angle plates 29 define an upright mount plate which is secured to the fork tubes 17 by the reinforcement tubes 39. The upper ends of the tubes 39 are secured to plate 35 as by welding with the ends of the tubes 39 diverging downwardly and outwardly and secured to the fork tubes 17 as by the welds 41 shown in FIG. 2.

Figure 4:
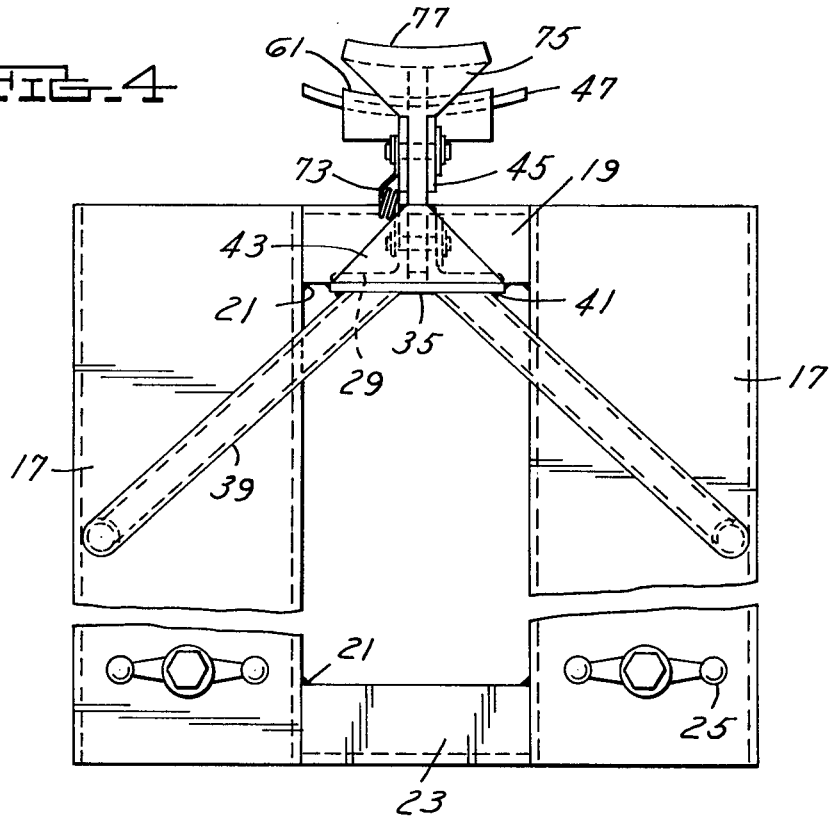
FIG. 4 is a fragmentary plan view thereof.

Top plate 43 of triangular shape FIGS. 2 and 4 spans the upper end of the angle plates 29 and is secured thereto as by the welds 41 FIG. 2. A pair of upright parallel spaced drum support plates 45, sometimes referred to as a drum support plate is parallel to and arranged forwardly of the mount plate 29. A first arcuate drum grip 47 extends transversely of plate 45 and is secured thereto as by welds 49 FIG. 2.

The upright drum support plate 45 is pivotally interconnected with the upright mount plate 29. For this purpose there is provided a pivot link 51 which extends between the webs 31 of the angle plates 29 and is pivotally connected thereto by pivot pin 53. Associated with the pivot pin at its opposite ends are snap springs 55 and washers 59.

The link 51 extends between plates 45 and is pivotally connected thereto intermediate the ends thereof by the transverse pivot pin 57 and associated snap rings 55 and washers 59.

A second arcuate drum grip 61 extends transversely of plates 45 towards their upper ends and is secured thereto as by the welds 63 FIG. 2.

The horizontally disposed latch link 65 is interposed between the webs 31 of the angle plates 29 which comprise the upright mount plate and is pivotally connected thereto by the transverse pivot pin 67 associated snap ring 55 and washers 59. The latch link 65 extends between the upper ends of the drum support plates 45 and is loosely pivoted thereto by the transverse pivot pin 71 which extends between plates 45 and through an elongated angular slot 68 (FIG. 2) formed in the latch link 65.

Torsion spring 73 at one end is anchored to the pivot pin 67 with the other end thereof connected to pivot pin 71 normally urging the upper end of the drum support plate 45 outwardly with respect to the adjacent mount plate 29.

The outer end of the latch link 65 terminates in the depending arcuate transversely extending third drum grip 77 which is adapted to operatively and retainingly engage over and against the interior of drum D in the manner shown in FIG. 1.

A transverse generally triangularly shaped latch plate 75 extends laterally of opposite sides of the latch link 65 adjacent the drum grip 77 and in the position of the latch link 65 shown in FIG. 2 is in retaining operative engagement with the upper end of the drum support plates 45 holding the plates in an upright position against the action of the torsion spring 73.

The position of the respective first and second grips 46 and 61 with respect to the third grip 77 is such as to retainingly engage outside and inside of the drum D respectively for gripping and elevating the same as shown in FIG. 1.

OPERATION

Assuming that the drum D has already been gripped by the drum lifter 15 and elevated from the support surface S as shown in FIG. 1, the truck F transports the drum and lowers it upon any suitable support S or deck or truck bed or other surface.

With the drum D resting upon the support surface S at point of delivery forks 13 through the elevator 11 are lowered slightly causing the lowering of the mount plate 29 with respect to the drum support plate 45 pivotally connected therewith. This causes an upward tipping movement of the latch link 65 from the drum gripping position shown in FIG. 2 to the dash line position shown, which corresponds to a "cocked" position. As the latch link 65 is tilted upwardly to the dash line position shown the latch plate 75 disengages from the forward edges of support plate 45 at its upper end so that the upper end portions of the drum support plate 45 under the action of the spring 73 will move outwardly away from adjacent upper portions of the mount plate 29, as shown in dash lines.

The upward pivotal movement of the latch link 65 and the successive corresponding outward pivotal movement of the support plate 45 at its upper end retains the latch link 65 in its cocked position shown in dash lines. The third transverse grip 77 has disengaged from the drum D so that upon further elevation of the forks 13 the associated drum D lifter 15 becomes disassembled from the drum which is left standing on a suitable support.

The latch link 65 will remain in the cocked position until a successive additional drum D is engaged since the latch plate 75 overlies the upper edges of drum support plate 45.

As the truck and associated drum lifter forks approach another drum D upon a support surface S the drum lifter 15 will be moved forwardly by the forks 13 until the first and second drum grips 47 and 61 operatively engage the outside surface of the drum D.

Engagement of the second drum D grip 61 with the drum causes the upper end portion of the drum support plates 45 to move inwardly towards the mount plate 29 against the action of the torsion spring 73. This provides a clearance for the latch plate 75 which is now free to drop to the latching position shown in FIG. 2. At the same time the third drum grip 75 is in operative gripping engagement with the interior surface of the drum.

Should for any reason the latch link 65 fail to drop from its cocked position to the horizontal position shown in FIG. 2, this can be acheived by a limited elevation of the forks 13 effecting a corresponding elevation of the mount plates 29 causing the latch link 65, latch plate 75 and the third drum grip 77 to return to the operative drum securing position shown in FIG. 2.

Having described my invention, reference should now be had to the following Claims.

I Claim:

1. A drum lifter comprising a base including a pair of parallel spaced fork tubes adapted for receiving at one end and positioning over a pair of vertically adjustable forks of a fork lift truck, and a support plate spanning and secured to the other ends of said tubes;

an upright mount plate supported upon and secured to said support plate;

means fixedly securing said mount plate to said fork tubes;

an upright drum support plate parallel to and arranged forwardly of said mount plate, pivotally mounted intermediate the ends upon said mount plate;

a first arcuate drum grip at the lower end of said drum support plate;

a second arcuate drum grip adjacent the upper end of said drum support plate, said first and second drum grips adapted to operatively engage the exterior of a drum to be lifted and transported;

a forwardly extending latch link pivotally supported upon said mount plate adjacent its upper end, loosely and pivotally mounting said drum support plate;

and a third arcuate drum grip depending from the forward end of said latch link adapted to operatively and retainingly engage over and against the interior of said drum.

2. In the drum lifter of claim 1, spring means upon said mount plate adjacent said latch link and interposed between said mount plate and the upper end of said drum support plate normally urging said upper end outwardly of said mount plate.

3. In the drum lifter of claim 2, said latch link including a transverse latch plte adjacent said third drum grip normally retaining the upper end of said drum support plate against outward movement;

upward pivotal movement of said latch link disengaging the upper end of said drum support plate for outward pivotal movement thereof relative to said mount plate;

said latch link pivoting upwardly to a cocked position moving said third grip to a drum disengaged position.

4. In the drum lifter of claim 1, said mount plate including a pair of spaced angle plates with opposed parallel spaced webs;

and plates spanning and interconnecting said angle plates intermediate their ends and at their upper ends.

5. In the drum lifter of claim 2, said spring means including a torsion spring at one end connected to the pivotal mounting of said latch link with said mount plate, its other end being connected to said drum support plate at its pivotal connection with said latch link.

6. In the drum lifter of claim 1, the pivotal mounting of said drum support plate upon said latch link including an elongated slot through said latch link, and a pivot pin upon said support plate and extending through said slot, whereby the upper end of said drum support plate is adapted to pivot outwardly, and the free end of said latch link and associated third grip is adapted to pivot upwardly to a cocked position.

7. In the drum lifter of claim 3, the pivotal mounting of said drum support plate upon said latch link including an elongated slot through said latch link, and a pivot pin upon said drum support plate and extending though said slot, whereby the upper end of said support plate may pivot outwardly of said mount plate and the free end of said latch link pivot upwardly to said cocked position.

8. In the drum lifter of claim 1, the pivotal mounting of said drum support plate upon said mount plate including a link at its ends pivotally connected respectively to said mount plate and said drum support plate.

9. In the drum lifter of claim 1, said drum support plate including a pair of spaced plates;

said first and second drum grips spanning and secured to said plates.

10. In the drum lifter of claim 9, the pivotal mounting of said drum support plate upon said latch link including an elongated slot through said latch link, and a pivot pin supported upon spanning and secured to said mount plates and extending through said slot.

11. In the drum lifter of claim 1, a wing bolt adjustably threaded into an end portion of each fork tube for operative retaining engagement with said forks.

12. In the drum lifter of claim 11, said fork tubes being rectangular in cross section;

said forks being similarly shaped for snug cooperative securing within said fork tubes.

13. In the drum lifter of claim 1, a reinforcing angle plate interposed between said fork tubes adjacent their said one ends and secured thereto.

14. In the drum lifter of claim 3, the lowering of said forks a limited amount after the drum retained by said three grips is resting upon a support surface, causing said latch link to pivot upwardly disengaging the third drum grip from said drum and permiting disengagement of the drum lifter from said drum on retraction of the fork lift truck, said latch link and the third grip being automatically elevated to a cocked position ready for interlock and gripping of the next drum for transporting the same.

15. In the drum lifter of claim 1, the means fixedly securing the mount plate to said fork tubes including a pair of reinforcement tubes at their upper ends secured to said mount plate, diverging downwardly and rearwardly and at their lower ends secured to said fork tubes.

16. A drum lifter adapted for attachment to a lifting device comprising a base and an upright mount plate supported upon and secured to said base;

an upright drum support plate parallel to and arranged forwardly of said mount plate, pivotally mounted intermediate the ends upon said mount plate;

a first arcuate drum grip at the lower end of said drum support plate;

a second arcuate drum grip adjacent the upper end of said drum support plate, said frist and second drum grips adapted to operatively engage the exterior of a drum to be lifted and transported;

A forwardly extending latch link pivotally supported upon said mount plate adjacent its upper end, loosely and pivotally mounting said drum support plate;

and a third arcuate drum grip depending from the forward end of said latch link adapted to operatively and retainingly engage over and against the interior of said drum.

17. In the drum lifter of Claim 16, spring means upon said mount plate adjacent said latch link and interposed between said mount plate and the upper end of said drum support plate normally urging said upper end outwardly of said mount plate.

18. In the drum lifter of Claim 17, said latch link including a transverse latch plate adjacent said third drum grip normally retaining the upper end of said drum support plate against outward movement;

upward pivotal movement of said latch link disengaging the upper end of said drum support plate for outward pivotal movement thereof relative to said mount plate;

said latch link pivoting upwardly to a cocked position moving said third grip to a drum disengaged position.

19. In the drum lifter of Claim 16, said mount plate including a pair of spaced angle plates with opposed parallel spaced webs;

and plates spanning and interconnecting said angle plates intermediate their ends and at their upper ends.

20. In the drum lifter of Claim 17, said spring means including a torsion spring at one end connected to the pivotal mounting of said latch link with said mount plate, its other end being connected to said drum support plate at its pivotal connection with said latch link.

21. In the drum lifter of Claim 16, the pivotal mounting of said drum support plate upon said latch link including an elongated slot through said latch link, and a pivot pin upon said support plate and extending through said slot, whereby the upper end of said drum support plate is adapted to pivot outwardly, and the free end of said latch link and associated third grip is adapted to pivot upwardly to a cocked position.

22. In the drum lifter of Claim 18, the pivotal mounting of said drum support plate upon said latch link including an elongated slot through said latch link, and a pivot pin upon said drum support plate and extending througb said slot, whereby the upper end of said drum support plate may pivot outwardly of said mount plate and the free end of said latch link pivot upwardly to said cocked position.

23. In the drum lifter of Claim 16, the pivotal mounting of said drum support plate including a link at its ends pivotally connected respectively to said mount plate and said drum support plate.

24. In the drum lifter of Claim 16, said drum support plate including a pair of spaced plates;

said first and second drum grips spanning and secured to said plates.

25. In the drum lifter of Claim 24, the pivotal mounting of said drum support plate upon said latch link including an elongated slot through said latch link, and a pivot pin supported upon spanning and secured to said mount plates and extending through said slot.

26. In the drum lifter of Claim 18, the lowering of the lifting device a limited amount after the drum retained by said three grips is resting upon a support surface, causing said latch link to pivot upwardly disengaging the third drum grip from said drum and permitting disengagement of the drum lifter from said drum on retraction of the lifting device, said latch link and the third grip being automatically elevated to a cocked position ready for interlock and gripping of the next drum for transporting the same.

* * * * *